US011383895B2

(12) United States Patent
Samartgis et al.

(10) Patent No.: US 11,383,895 B2
(45) Date of Patent: Jul. 12, 2022

(54) STORAGE CONTAINER WITH CLIP

(71) Applicant: The Decor Corporation Pty. Ltd., Dandenong South (AU)

(72) Inventors: Jim Samartgis, Bulleen (AU); Graeme Wilson, Kallista (AU)

(73) Assignee: The Decor Corporation Pty. Ltd., Dandenong South (AU)

( * ) Notice: Subject to any disclaimer, the term of this patent is extended or adjusted under 35 U.S.C. 154(b) by 271 days.

(21) Appl. No.: 16/484,514

(22) PCT Filed: Feb. 9, 2018

(86) PCT No.: PCT/AU2018/050104

§ 371 (c)(1),
(2) Date: Aug. 8, 2019

(87) PCT Pub. No.: WO2018/145166

PCT Pub. Date: Aug. 16, 2018

(65) Prior Publication Data

US 2020/0002061 A1 Jan. 2, 2020

(30) Foreign Application Priority Data

Feb. 9, 2017 (AU) ..... 2017900398

(51) Int. Cl.

| | |
|---|---|
| ***B65D 43/02*** | (2006.01) |
| ***B65D 45/20*** | (2006.01) |
| ***B65D 51/16*** | (2006.01) |

(52) U.S. Cl.

CPC ..... *B65D 43/02* (2013.01); *B65D 45/20* (2013.01); *B65D 51/1694* (2013.01); (Continued)

(58) Field of Classification Search

CPC ..... B65D 45/20; B65D 51/1694; B65D 2543/00194; B65D 2543/00564; B65D 2543/00888; B65D 43/267

(Continued)

(56) References Cited

U.S. PATENT DOCUMENTS

| | | | |
|---|---|---|---|
| 798,513 | A | 8/1905 | Kent |
| 970,037 | A | 9/1910 | Gilfillan |

(Continued)

FOREIGN PATENT DOCUMENTS

| | | | |
|---|---|---|---|
| CN | 203740305 | U | 7/2014 |
| CN | 103723352 | B | 1/2017 |
| EP | 2592013 | A1 | 5/2013 |

OTHER PUBLICATIONS

Gang Shen; International Search Report and Written Opinion; International Application No. PCT/AU2018/050104; dated Jun. 5, 2018; Australian Patent Office; Woden, ACT, Australia.

*Primary Examiner* — James N Smalley
(74) *Attorney, Agent, or Firm* — Stevens & Showalter LLP

(57) ABSTRACT

A storage container comprising a container base having an upper opening defined by a peripheral top edge of the base; a removable lid with a circumferential seal, wherein the lid sealingly sits across the upper opening of the base; and a clip mounted to the base to rotate between an engaged position whereby the clip engages the lid against removal, and a disengaged position; wherein the clip includes a contact surface that as the clip rotates from the engaged position to the disengaged position, the contact surface is moved to lift the lid.

13 Claims, 11 Drawing Sheets

(52) U.S. Cl.
CPC ..... *B65D 2543/00194* (2013.01); *B65D 2543/00564* (2013.01); *B65D 2543/00888* (2013.01)

(58) Field of Classification Search
USPC ..... 220/285, 318, 367.1, 785
See application file for complete search history.

(56) References Cited

U.S. PATENT DOCUMENTS

| | | | | | |
|---|---|---|---|---|---|
| 3,176,880 | A * | 4/1965 | Archbold | B65D 81/2053 | 222/158 |
| 4,351,449 | A | 9/1982 | Zobel | | |
| 5,040,834 | A * | 8/1991 | Kahl | E05C 3/048 | 292/204 |
| 5,065,885 | A * | 11/1991 | Scaroni | B65D 45/22 | 220/326 |
| 6,415,786 | B1 * | 7/2002 | Kolbe | A62B 25/00 | 128/200.24 |
| 6,644,492 | B1 * | 11/2003 | Mitchell | B65D 43/0212 | 215/305 |
| 6,666,348 | B2 * | 12/2003 | Fore | B65D 1/26 | 220/315 |
| 6,789,692 | B2 * | 9/2004 | Prezelin | B65D 45/20 | 190/119 |
| 7,748,232 | B2 * | 7/2010 | Kang | F25D 23/026 | 62/371 |
| 9,713,813 | B2 * | 7/2017 | Ballhause | B65D 45/04 | |
| 10,227,165 | B2 * | 3/2019 | Audette | B65D 45/06 | |

* cited by examiner

STORAGE CONTAINER WITH CLIP

The present invention relates to a storage container of the type including a removable lid that can be attached to a container base in a sealing manner, and including clips to assist in attaching and removing the lid to and from the base.

BACKGROUND

Storage containers, particularly those for domestic use, are found in most households. In the pursuit of improving the sealing technology of storage containers elaborate sealing means and/or attachment mechanisms have been developed, which while this may have succeeded in creating air tight and leak proof seals, has also resulted in the container lid being more difficult to remove against lower pressure forces inside the sealed container. In such situations, users are faced with difficulty in, first finding sufficient purchase on the lid and then applying sufficient force to pull the lid off the base.

Venting means, for example in the form of plug vent holes on the lids, can assist in equalising the pressure inside the container making lid removal easier. Side clips between the container base and lid provide better purchase than a slim tab on the side edge of a lid, but while clips may unfasten a locking engagement between the lid and base, there still remains the problem to users in first ensuring lids are properly and sealingly seated on the container base, and then removing the lids against an internal pressure difference inside the container.

The present storage container seeks to improve the manner in which a container base and lid are engaged and removed.

SUMMARY

In accordance with the invention there is provided a storage container comprising a container base having an upper opening defined by a peripheral top edge of the base; a removable lid with a circumferential seal, wherein the lid sealingly sits across the upper opening of the base; and a clip mounted to the base to rotate between an engaged position whereby the clip engages the lid against removal, and a disengaged position;

wherein the clip includes a contact surface that as the clip rotates from the engaged position to the disengaged position, the contact surface is moved to lift the lid.

In a preferred embodiment the clip is mounted to the base on a rotational axis that is substantially parallel and beneath a peripheral downwardly depending edge of the lid. The rotational axis is positioned alongside and offset the top edge of the base. More specifically, the upper end/top edge of the base includes a clip cut-out in which the clip is adapted to sit between two end hinges.

In one embodiment the contact surface is a levered edge of the clip that, as the clip rotates, the levered edge is levered about the rotational axis to engage the underside of the lid and raise it. In a specific embodiment, one or more struts depending downwardly from the underside of the lid define the lowest part of the lid in the vicinity of the rotating clip, and therefore the clip's levered edge will contact the struts. As the clip continues to rotate the levered edge progressively levers against the struts against the force of the seal and pushes the lid off its seat on the base.

Alternatively, or in addition, the contact surface can be, or can also be, a cam mechanism, or cam member, that lies on the rotational axis of the clip, and is specifically located where the clip is attached to a sidewall of the container, namely at the end hinges. The hinges are each defined by a lug or a pin on the base interacting with end catches on the clip. The pins project into the clip cut-out and a corresponding end catches in the form of circular hooks on the clip, whereby the hooks have an opening that resiliently hook onto the respective pin and rotate thereon. The cam mechanism is provided on the clip's end catches. Alternatively, the cam mechanism could be provided adjacent or near to the end catches, which are part of the end hinges. The cam mechanism is in one embodiment defined as a cam surface. The cam mechanism is adapted to wedge against the underside of the lid to raise it out of its sealed position on the base.

In accordance with the present invention there is further provided a storage container comprising a container base having an upper opening defined by a peripheral top edge of the base; a removable lid with a circumferential seal, wherein the lid sealingly locates across the upper opening of the base; and a clip mounted to the base at end hinges to rotate between an engaged position whereby the clip engages the lid against removal, and a disengaged position whereby the clip does not engage the lid;

wherein the clip includes a cam surface at or adjacent to at least one end hinge, so that as the clip rotates from the engaged position to the disengaged position the cam surface is moved to lift the lid against the sealing force of the seal.

In one embodiment, the cam mechanism is defined by a pivoting hinge component of the clip that, in cross section, has a narrow section leading into a larger section that as the clip rotates from the engaged to the disengaged position, it wedges through a gap between the underside of peripheral edge of the lid and the pivot pin. Continued rotation increases the wedging force as the cam under the lid edge moves to the larger section. The clip pushes against the sealing force of the lid's seal and towards the end of the rotation the lid is lifted off its seat on the base's top edge. This in turn allows a user to easily remove the lid without undue force in pulling the lid off the base. In this embodiment, the pivoting hinge component is provided as one or more end catches of the clip.

The clip preferably has a pivoting portion and a gripping portion, and forms a lever to drive the levering motion of the levered edge, or of the cam mechanism. The levered edge is preferably a longitudinal end edge of the clip at the pivoting portion, and may be enlarged, or bulbous, or otherwise shaped in profile, to function as a contact surface in reaction to being levered against the underside of the lid.

Rotating the clip in the direction to engage with the lid, the lid is located on the top edge of the base, and with the lid struts resting on the levered edge of the clip. As the clip is levered toward the engaged position the contact surface of the levered edge rotates out of the way to drop the lid. Continued rotation of the clip brings it up and over an outer side wall of the lid where the clip locks onto the lid by locating a lug on the underside of the clip into a corresponding lug recess on the lid's outer side wall.

The clip may be configured to interact with the lid so that as the clip engages the lid, an audible click is made thereby indicating complete engagement.

The circumferential seal on the underside of the lid is preferably a vertical seal that sits tight against an inside wall of the base. The seal could alternatively be a lip seal. The circumference of the seal, in one embodiment, is slightly larger than the circumference of the inner wall of the base so as to create a tight engagement therebetween.

There may also be provided a venting means in various forms. In one embodiment the venting means may be an inclined, chamfered, vent cut-out on an inner edge of the top edge of the base.

In another embodiment the vent could be an aperture in the side wall of the lid in the vicinity of the clip so that as the clip rotates a venting plug on the underside of the clip plugs the vent aperture.

Still alternatively, the vent may be provided in the form of a purpose designed venting button on a central area of the lid's upper surface. Such vent buttons, and variations thereof, are well known and will not be discussed further here.

The base, clip and lid are preferably made of a plastics material that is durable for repeated re-use, microwaveable and dish-washable. Examples of such materials include homopolymer or copolymer polypropylenes.

The circumferential seal may be overmoulded on the lid, or may be separately moulded and then assembled with the lid. The seal could be made of a suitable seal material that provides some flexibility or resilience. An example of such a material is thermoplastic rubber (TPR).

BRIEF DESCRIPTION OF THE DRAWINGS

Embodiments, incorporating all aspects of the invention, will now be described by way of example only with reference to the accompanying drawings in which.

DETAILED DESCRIPTION

Figure 2:
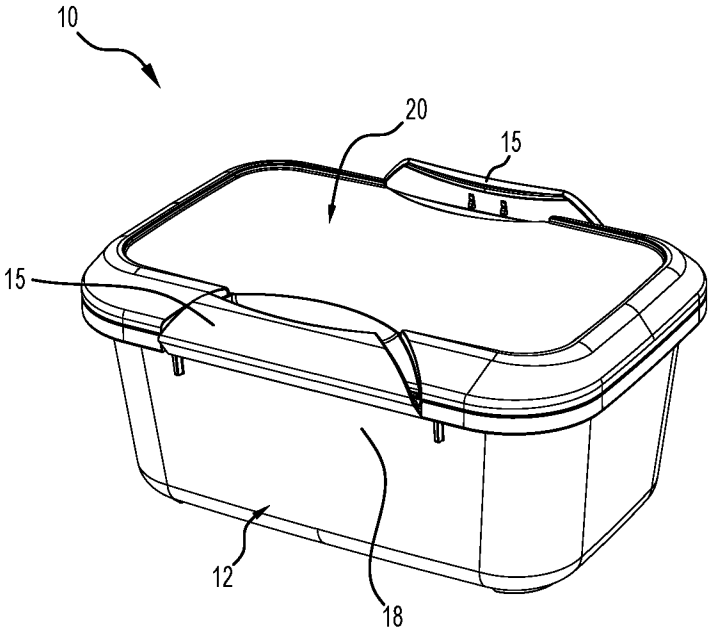
FIG. 2 is an upper isometric view of the container with clips partially open.

The drawings illustrate an improved storage container 10 with side clips 15. The storage container has a container base 12 that is open at a container opening 14 at an upper end which is defined by an open top edge 13. A removable lid 20 sits across the upper opening of the base and on the top edge 13, and a circumferential seal 22 that is provided on an underside 23 of the lid 20 ensures that the lid engages the base with a sealing fit.

At least one clip, and in the embodiment illustrated there are two clips 15, is mounted to a side wall 18 of the container base 12 in proximity to the top edge 13 to rotate between an engaged position whereby the clip 15 engages the lid preventing its removal, and a disengaged position whereby the clip is disengaged from the lid to allow the lid to be freely removed. The disengaged position also includes a lifting position whereby even after the clip is no longer engaged with the upper surface of the lid, it continues to rotate to a position where it lifts, or levers, the lid off its seat on the top edge of the base.

To assist a user in removing the lid from the base, especially where the pressure inside the sealed container is lower than the atmospheric pressure so that the pressure differential creates a suction effect that would otherwise require a reasonable amount of force to remove the lid, the clip includes a contact surface in the form of a levered edge 31 that uses the levering action of the rotating clip as it moves from the engaged position to the disengaged position, and more particularly to the lifting position, to push against the sealing force of the seal 22 and lift the lid, even if only slightly, off the base top edge 13 so that a user can effortlessly complete the removal process of the lid.

It is understood that even where the seal does not provide a strong sealing force that needs to be overcome, the clips can be used to lift the lid and generally make it easier for a user to grasp the edge of the lid and remove it from the container base. The levered edge 31, which extends substantially along the length of the clip at the clip's pivot point, has a surface that contacts one or more, and in this case two, struts 25 on the underside of the lid to move the lid.

The contact surface is described herein as a levered edge or positioned on the levered edge. In one embodiment, the contact surface could comprise a form other than an edge that is levered to push against the underside of the lid. For example, the contact surface could be a wedge and/or a cam mechanism 30 (discussed in more detail below) as illustrated in the drawings, whereby the cam mechanism wedges under the sealed lid and a cam surface of the cam mechanism 30 wedges the lid off its seat. Indeed, an embodiment of the storage container may include both a levered edge 31 that contacts the lid underside and a cam mechanism 30.

The seal 22 locates tightly against an inner surface 21 of base side wall 18, and in a preferred embodiment the circumferential cross length of the seal 22 is slightly larger than a corresponding length of the inner surface 21 of the base wall 18. This ensures a tight fit between base wall 18 and the more flexible seal 22. It is this tight fit that needs to be overcome in order to free the lid from the base.

As described above, the levered edge 31 does the initial work of overcoming the sealing force between the seal 22 and base 12. Driven by the levering force of the rotating clip 15, the levered edge 31 un-seats the lid from its sealed engagement with the base. The lid 20 is lifted slightly off its seat at the top edge 13 of the base 12. The lid 20 need not be lifted fully off the top edge 13 but sufficiently to allow a user to grasp the side edges 26 of the lid and remove the lid 20 from the base 12 without the need to pull against a tight sealing force, which has already been overcome by the levering clip.

Figure 1:
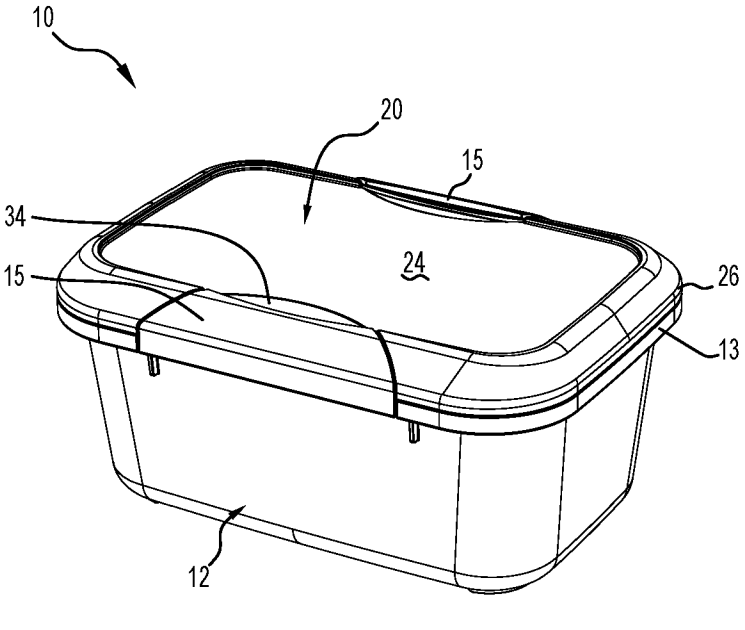
FIG. 1 is an upper isometric view of a storage container in accordance with an embodiment of the present invention in the closed position.
Figure 3:
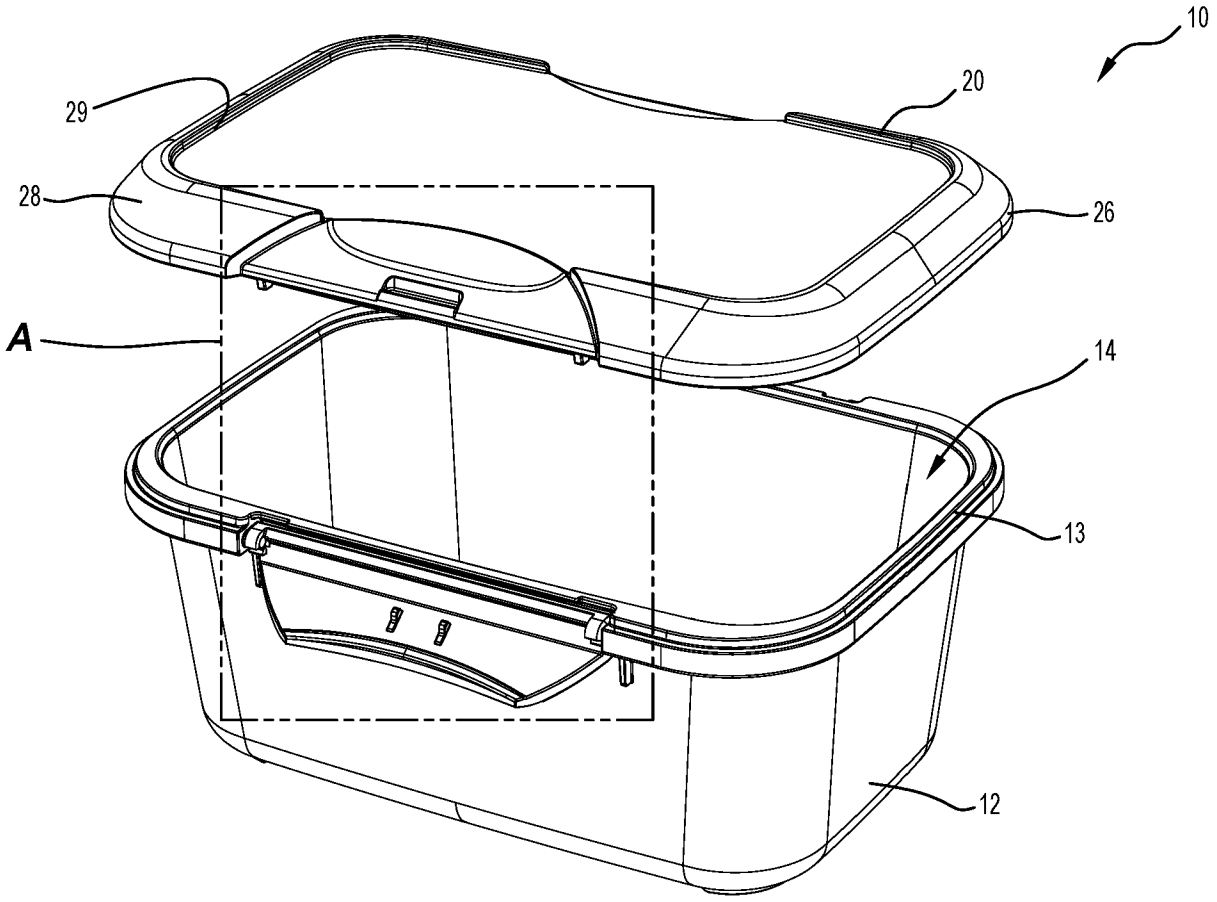
FIG. 3 is an upper isometric view of the container with lid removed.

FIGS. 1, 2 and 3 illustrate the components of the storage container 10. The lid 20 is a planar member that sits across the container opening 14 has an upper surface 24, an underside 23 and peripheral side edges 26 that depend downwardly and are profiled to correspond with and sit on the corresponding top edge 13 of the base 12, which is similarly profiled to correspondingly engage with the side edge of the lid 20.

Figure 5:
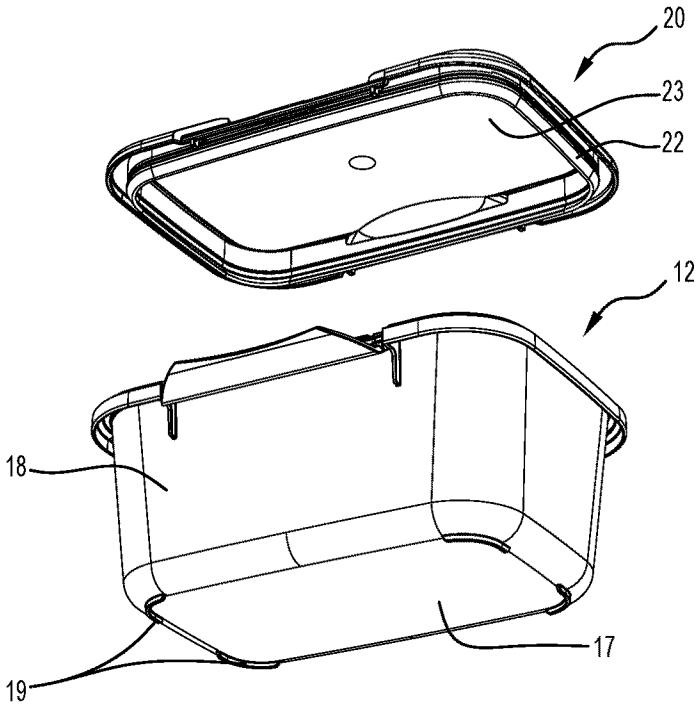
FIG. 5 is a lower isometric view of the container with lid removed.

A peripheral skirt 28 on the lid 20 transitions the upper surface 24 of the lid to the side edge 26 through an inclined surface of approximately 40° to 50° angle. The top of the skirt 28 meets upper surface 24 at a step 29 that steps down from the skirt onto the upper surface 24. Step 29, which extends around the perimeter of the upper surface 24, is adapted to allow for a container base as shown in the Figures to nestle and stack on top of the lid. Specifically, feet 19 on the outside of a bottom wall 17 of the container base 12 (see FIG. 5), will sit against the step 29 on the lid 20. Accordingly, similar containers with their lids on can be stably stacked one atop the other.

The lid 20 also includes a clip niche 33 formed within the skirt (see FIG. 4), and specifically at opposite sides of the lid 20 in order to accommodate the correspondingly shaped clip 15 when the clip is in the engaged position. The clip niche 33 means that in the engaged position the clip 15 can lie flush with the skirt 28, and not sit proud of the lid. This provides a compact container design. Furthermore, the clip niche 33 extends further into the lid 20 than the clip (in the closed/engaged position) leaving an area at the apex of the clip recess that functions as a finger recess 34 giving a user space to hook under and grip the underside 32 of clip 15 in order to unclip it from the lid and begin rotation to the open/disengaged position. FIG. 1 illustrates the clip in the closed, or engaged position, lying adjacent finger recess 34, while FIG. 2 illustrates clip having been unclipped and slightly lifted from its closed position. FIGS. 13 to 16 also illustrate in sequence the clip being rotated from an engaged to a disengaged position.

Figure 4:
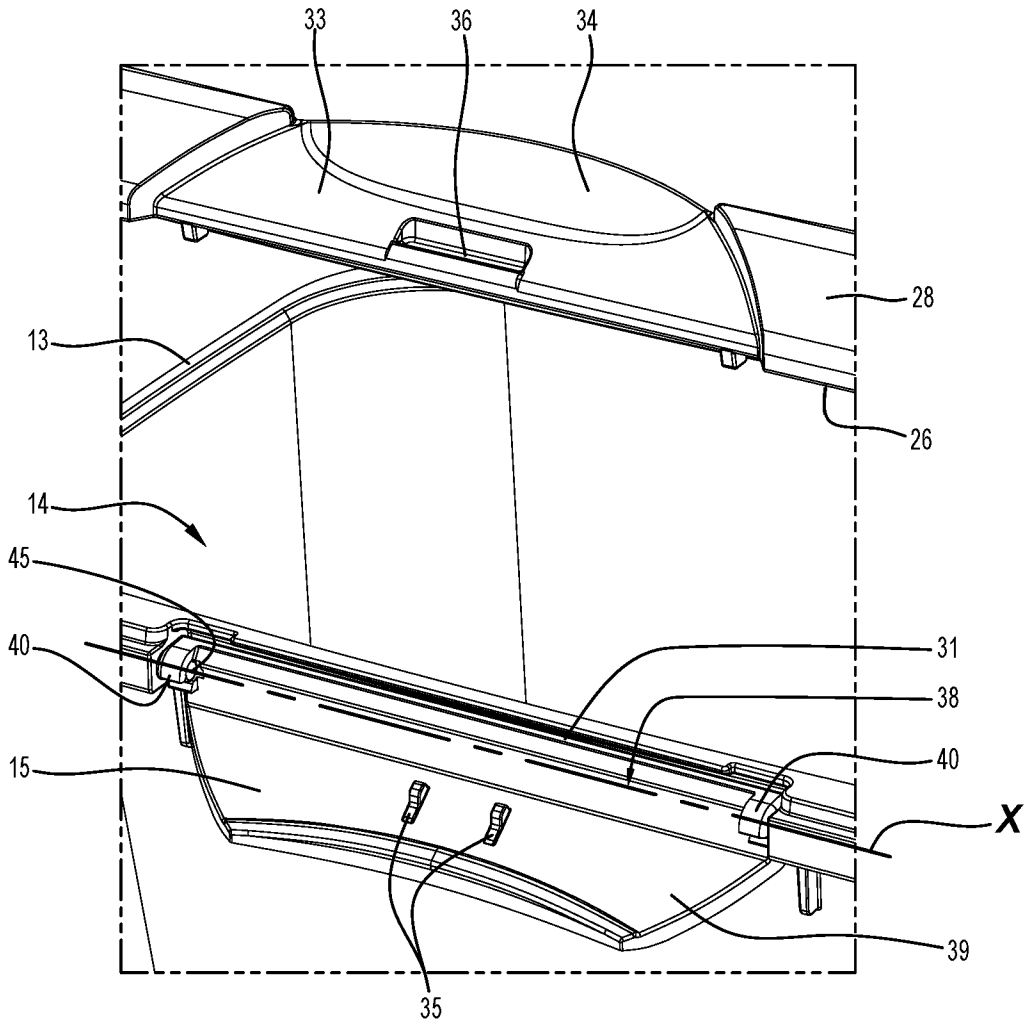
FIG. 4 is an enlarged view of the Area A shown in FIG. 3.
Figure 9:
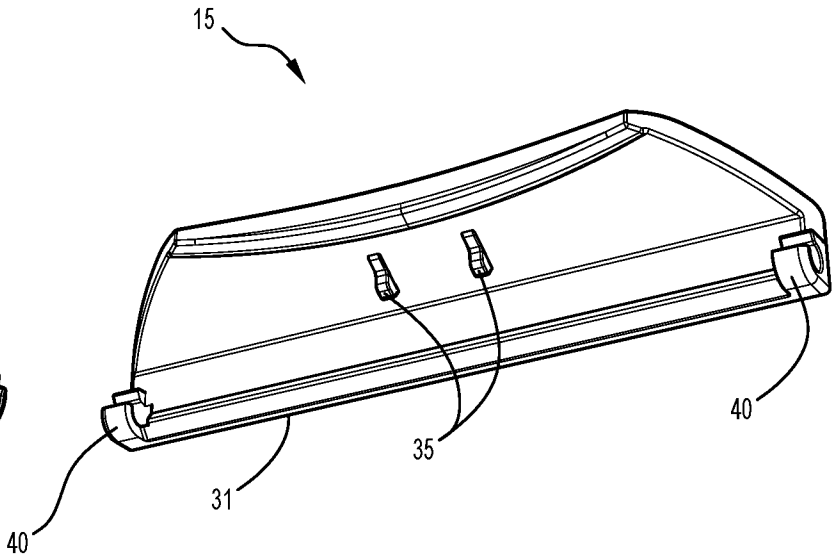
FIG. 9 is a rear isometric view of the clip.
Figure 8:
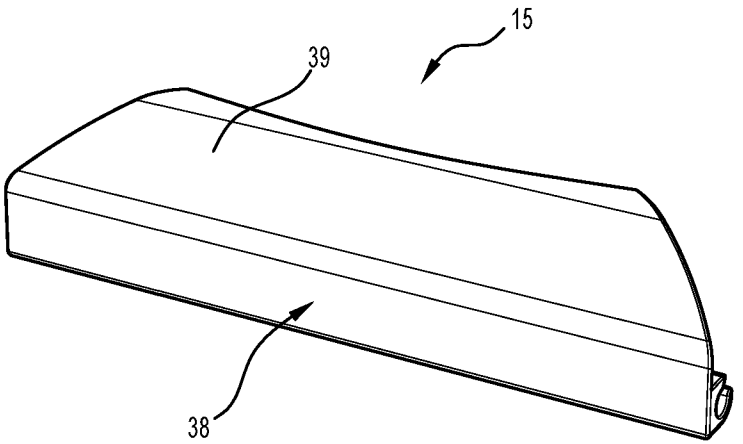
FIG. 8 is a front isometric view of a clip of the container.

FIGS. 4 and 9 illustrate a close view of the underside of clip 15. The clip 15 includes a pivoting portion 38, which sits close to a rotational axis X of the clip and also includes end catches for mounting the clip 15 to the base 12. Specifically, the end catches are circular, or "C", hooks 40 formed toward the ends of the portion 38 that mount to pivot on respective pins 45 on the base. The end catches on the clip and pins on the base form hinges between the clip and base.

The clip 15 also includes a handle 39 by which the clip can be gripped and levered. Two clipping lugs 35 on the underside of each clip 15 are adapted to resiliently fit over and into a clipping recess 36 provided on the lid skirt 28 at the clip niche 33. As lugs 35 insert over a bottom edge of the clipping recess 36 an audible click will be heard thereby indicating that the lid has been locked, or engaged, onto the base by the clips.

Figure 6:
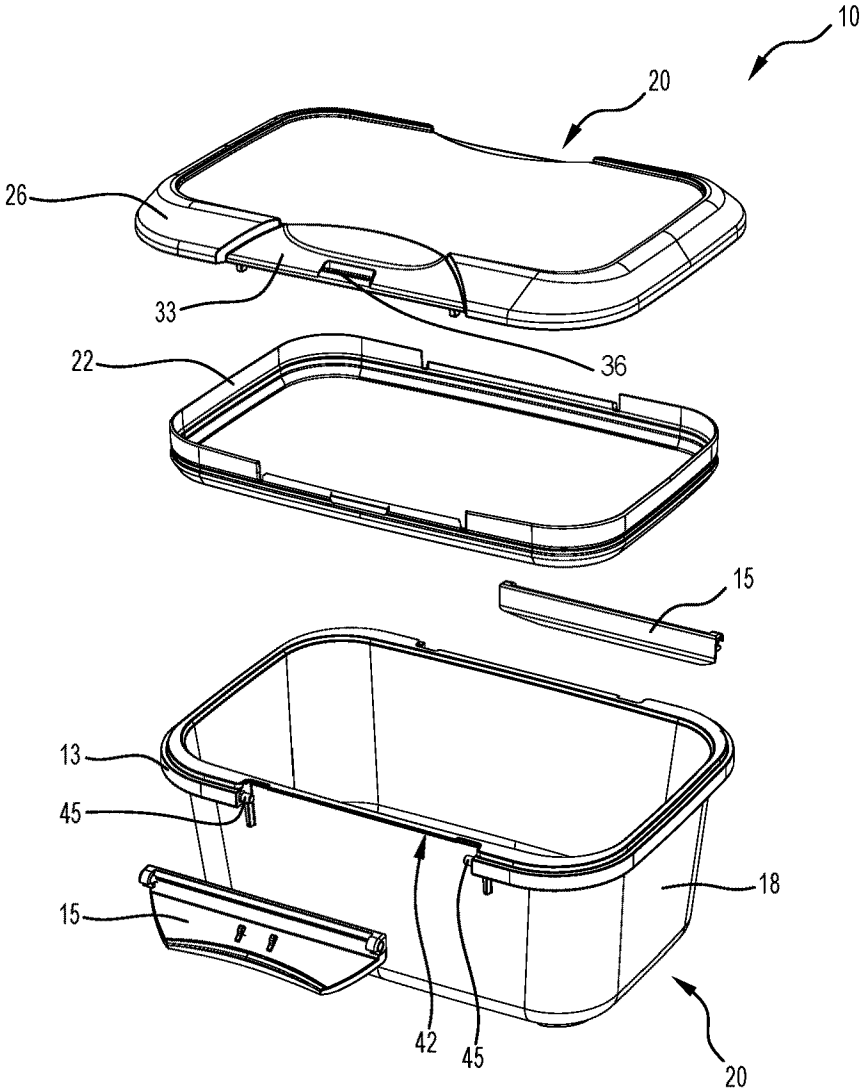
FIG. 6 is an upper isometric, exploded view of the container and its components.

As best illustrated in FIGS. 4 and 6, each clip 15 is mounted to the side wall 18 of the base 12 on rotational axis X that is substantially parallel and offset (located just below) the top edge 13 of the base, and therefore closely below the peripheral side edge 26 of the lid when the lid is positioned on the base. The top edge 13 of base 12 is profiled in the form of a downward lip that protrudes outwardly of the vertical side walls 18. However, where clip 15 is mounted the protruding lip of top edge 13 is cut to accommodate the pivoting portion 38 of the clip (see FIGS. 4 and 6) in a clip cut-out 42. Accordingly, clip 15 sits substantially flush with the protruding lip of top edge 13.

The rotational axis X is defined by the length of the pivoting portion 38 of the clip mounted at the C hooks onto pivot pints 45 located at the ends of clip cut-out 42 and facing each other (see FIG. 6). Together, the C hooks 40 and the pivot pins 45 on which the C hooks are resiliently clipped onto in a pivoting snap fit, form a pivot hinge 47 and provide for rotation of the clip 15 between an open and closed (engaged or disengaged) position with respect to the lid 20.

Figure 16:
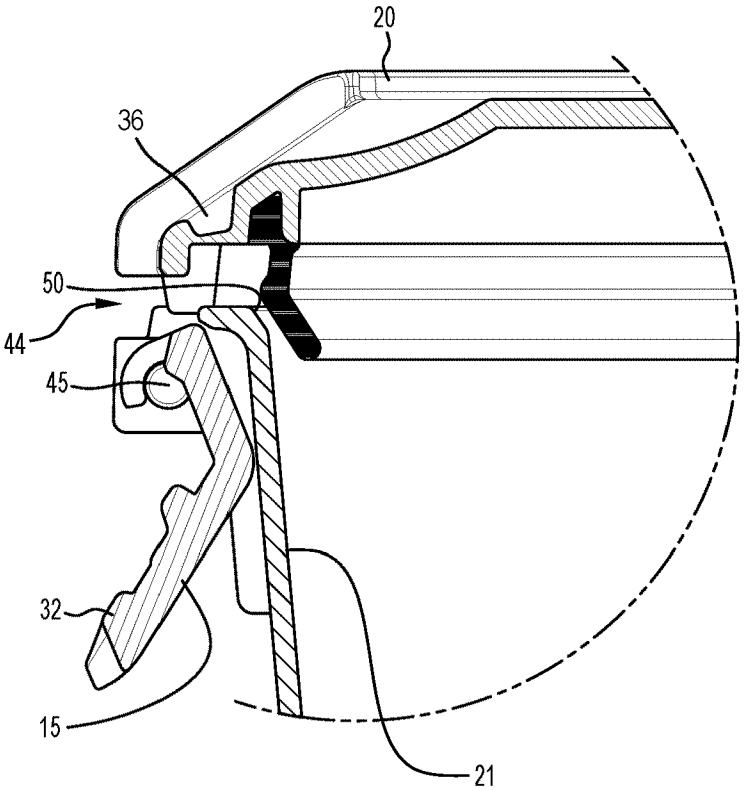

FIGS. 13 to 16 illustrate in sequence cross-sectional views (taken at section B-B in FIG. 7) how rotating clip 15 lifts lid 20. FIGS. 13 to 16 illustrate the extent to which the lid 20 can be lifted off base 12 through progressive rotation of clip 15 from its engaged position with lid 20 (FIG. 13) through to its fully disengaged, and open, position (FIG. 16).

Figure 13:
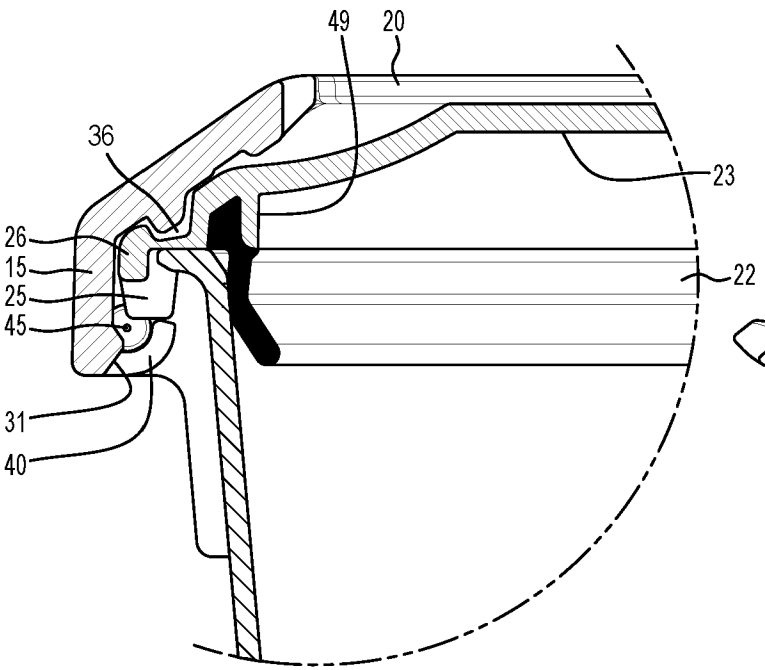

FIG. 13 illustrates the clip in the engaged position with the lid, with clip lugs 35 snapped into clipping recess 36 on the lid 20. As a user lifts clip out of engagement with lid 20 and rotates the clip (counter-clockwise as shown in FIG. 13) around the rotational axis X on pivot pins 45, the levered edge 31 of clip 15 begins to rotate around rotational axis X toward to the lid edge 26 and specifically toward lid struts 25.

Figure 14:
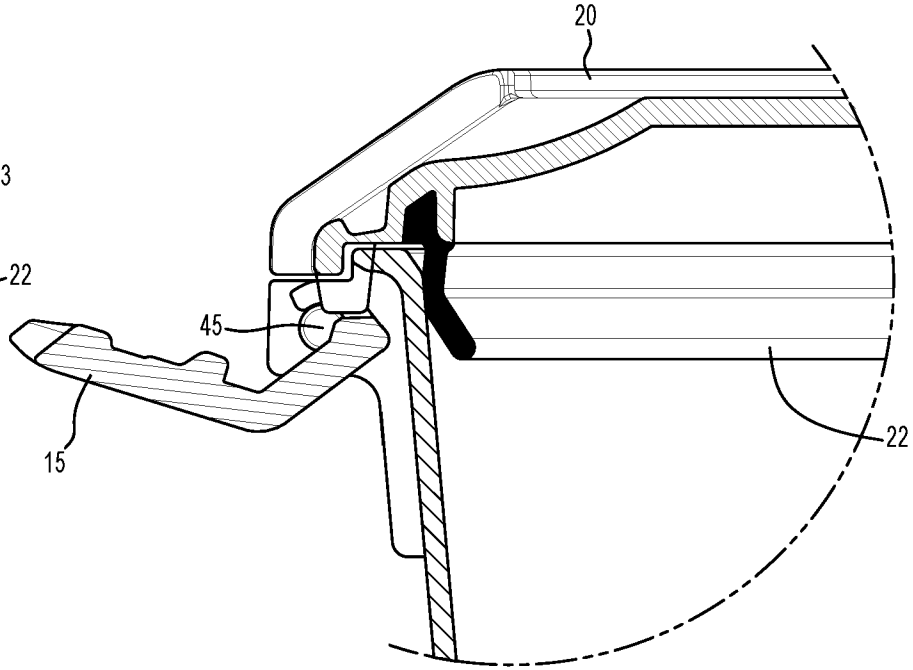
FIGS. 13, 14, 15 and 16 are a sequence of cross sectional views of another embodiment of the invention but taken at the equivalent of section B-B in FIG. 7, and showing a midpoint of the clip as it moves progressively from an engaged position with the lid (FIG. 13) to a fully disengaged position with the lid (FIG. 16)
Figure 15:
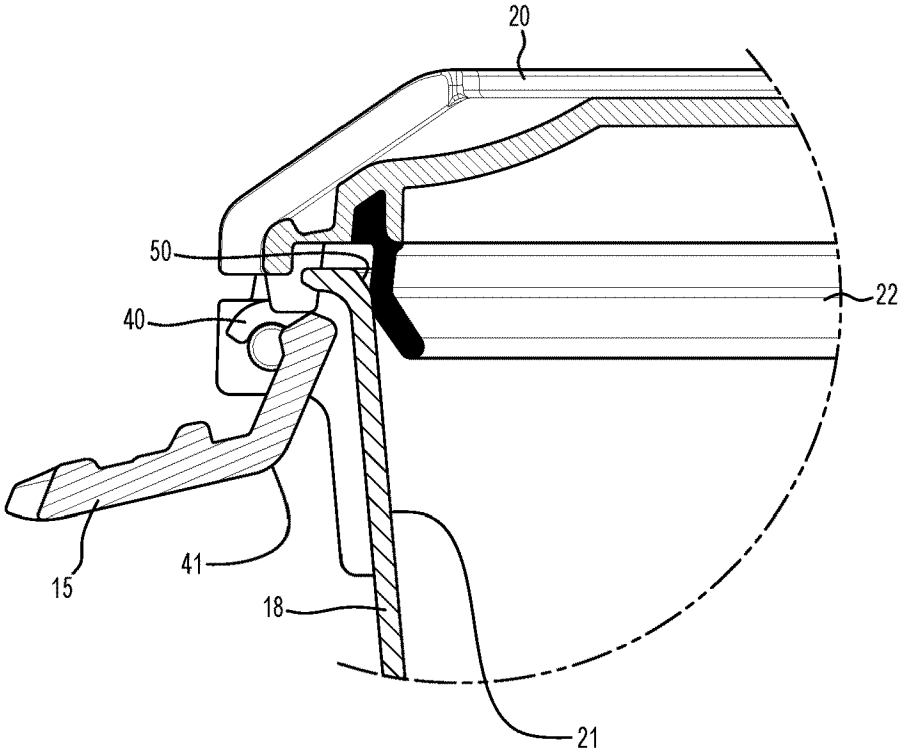

FIG. 14 shows clip rotated approximately 120° and at the point where levered edge 31 begins to make contact with one of the struts 25. With further rotation as shown in FIG. 15 the clip levers strut 25, and hence lid 20, upwards off the base top edge 13 and forces seal 22 to slide up against inner surface 21 of side wall 18.

Still further rotation of clip 15 brings it to its end position as shown in FIG. 16 where an elbow 41 of the clip abuts wall 18 stopping further rotation. The elbow 41 serves to mark the end of clip rotation when the elbow abuts against side wall 18, as illustrated in FIG. 16. At this point the lid 20 will have reached its highest lifted position, and the handle 39 part of the clip juts outwardly and is accessible for grabbing hold.

At the lid's most raised position, there can be seen a gap 44 between lid 20 and top edge 13 of base 12. Seal 22, too, has been lifted sufficiently away from wall 18 to allow a user to easily remove the lid 20 without using excessive force to pull against the pressure difference created by seal 22.

Figure 11:
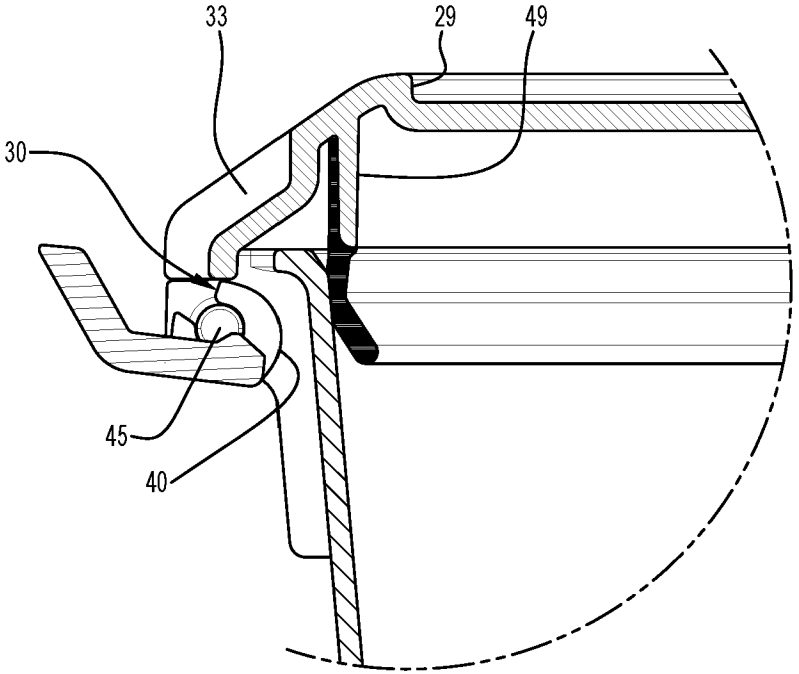
FIGS. 10, 11 and 12 are a sequence of cross sectional views taken at section A-A in FIG. 7, and showing the end of the clip as it moves progressively from an engaged position with the lid (FIG. 10) to a fully disengaged position with the lid (FIG. 12)
Figure 10:
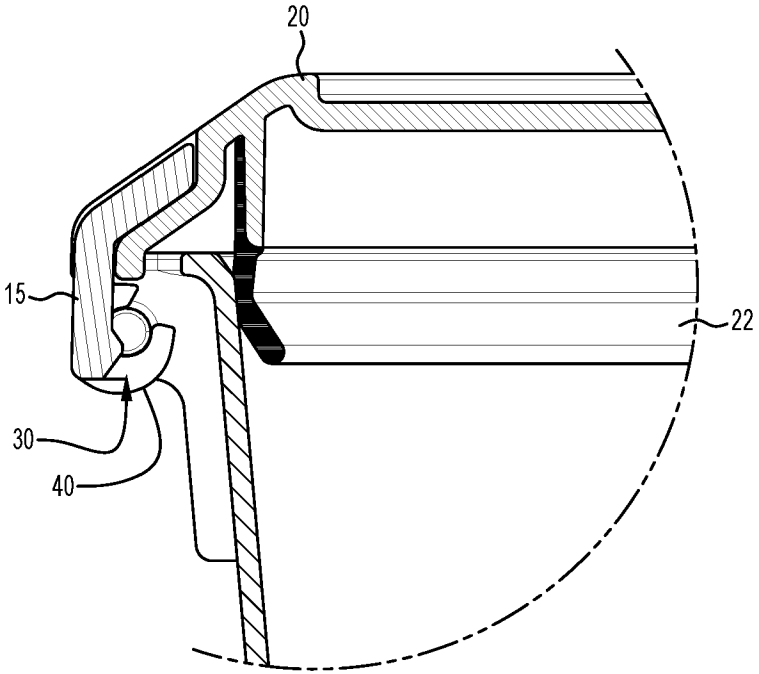
Figure 12:
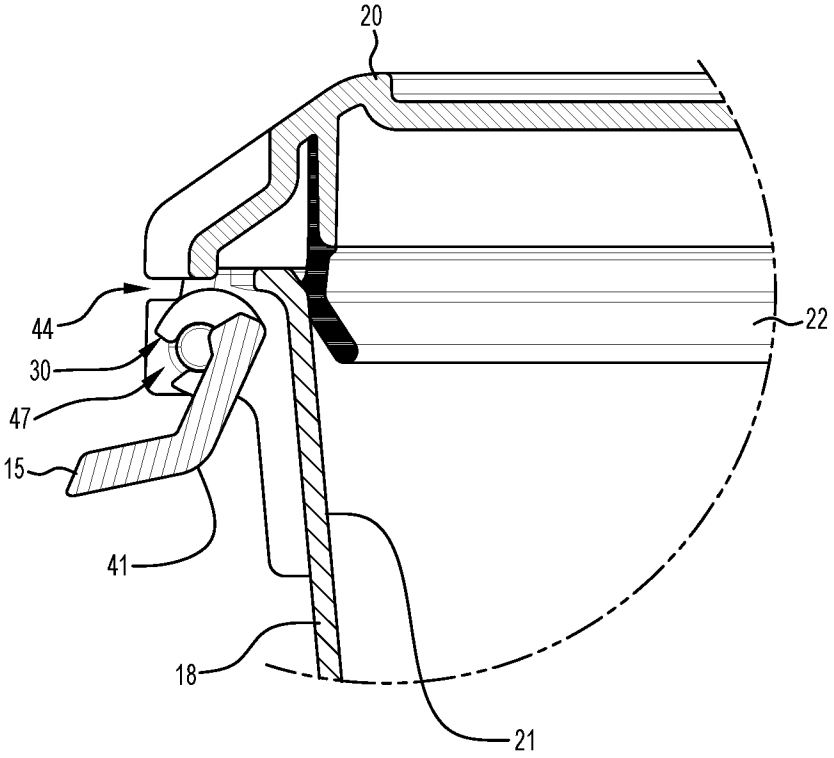

In the present drawings, the optional cam mechanism 30 is only illustrated in the embodiment of FIGS. 10 to 12. The cam mechanism 30 in the embodiment illustrated in FIGS. 10 to 12 is provided on the hinge itself, and more specifically on the C hooks 40.

Figure 7:
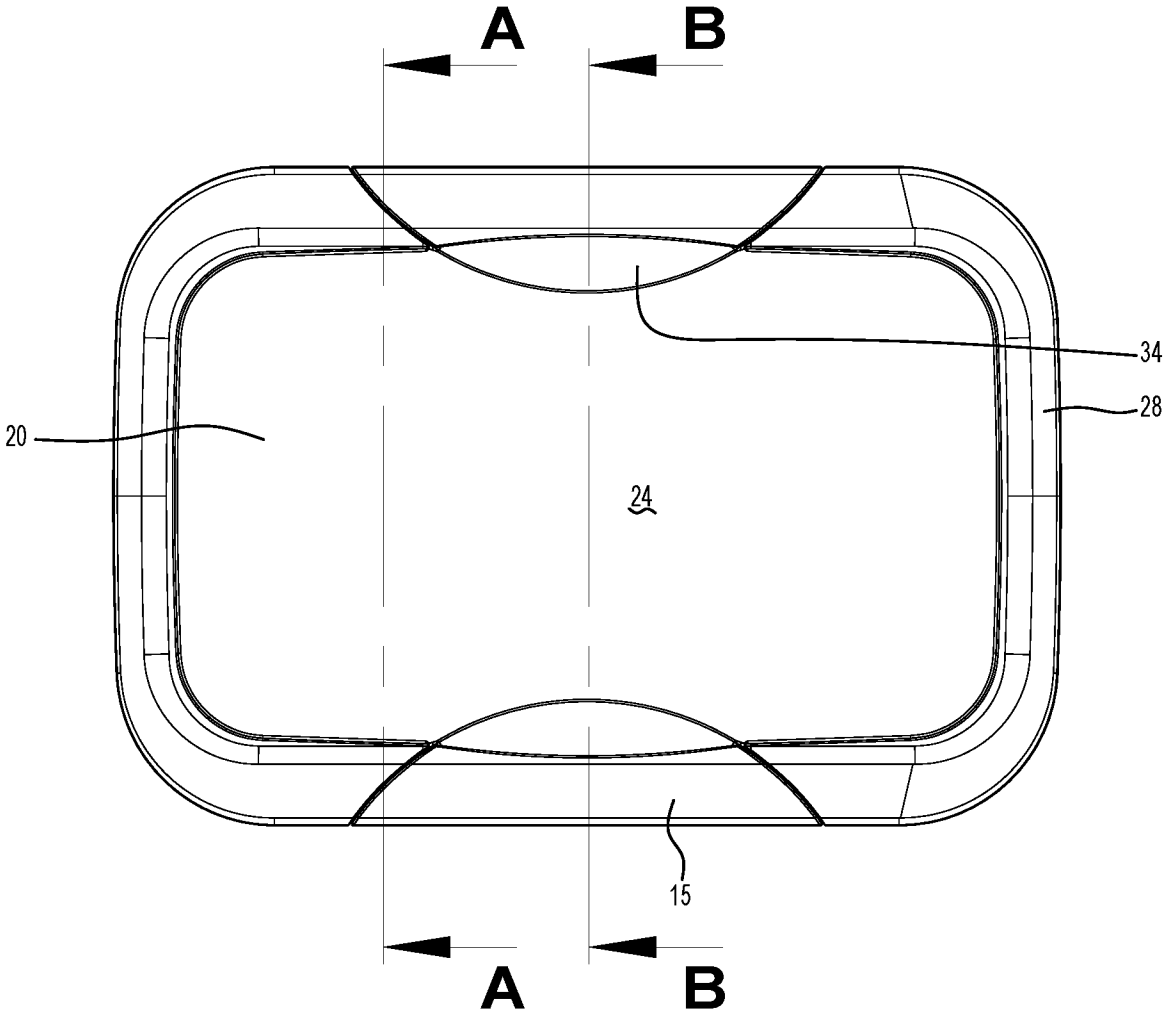
FIG. 7 is a top view of the container.

FIGS. 10 to 12, which are a sequence of views taken at section A-A of FIG. 7, show an embodiment of the container that includes cam mechanism 30. In the embodiment showing the cam mechanism 30, the C hooks 40 are profiled to have a narrower nose section at the open end of the "C" profile that broadens into a larger section thereby forming a cammed surface. The C hooks 40, being located immediately below the lid edge 26, rotate as the clip is pivoted so that the cam C hook first wedges into a gap between the lid edge 26 and the pivot pin 45 and then with continued rotation the wedging force increases as the cam C hook located under the lid edge 26 moves to the larger section of the cam profile. This movement is shown in the cross-sectional sequence diagrams of FIGS. 10, 11 and 12, which illustrate the effect of rotating clip 15 from its engaged position of FIG. 10 through to its fully disengaged position of FIG. 12. This in turn allows a user to easily remove the lid without undue force having to pull the lid off the base because the sealing force has already been overcome by the levering motion of the clip 15 whether by the levered edge 31 or by the cam mechanism 30 at the pivot hinge 47, depending on which contacts the lid first, or even both the levered edge and cam mechanism if they are flush and at the same level with each other.

In the embodiment shown in FIGS. 13 to 16, on the other hand, there is no cam mechanism 30 as such, but rather C hooks 40 have a consistent thickness in profile. The lifting motion of the lid in this embodiment is driven by the contact surface of the levered edge 31, which is profiled to progressively wedge under struts 25. Specifically, the levered edge 31 includes a ramped contact surface that slides under the lid struts imparting an upward lifting force on the lid. The ramped surface does the same function as the cam member, in that it is a pivoting component that is profiled to progressively increase a lifting force on the underside of the lid.

It is understood that the levering force of the rotating clip can be used to lever any contact surface on the clip to raise the lid, whether it is the levered edge 31, cam mechanism 30 or another surface. Accordingly, as used herein, the term "contact surface" can apply to the levered edge 31 or alternatively to the cam mechanism 30 on the C hook 40, or indeed to both. Still further the contact surface could apply to another component of the clip, not described herein, that rotates with or forms part of the clip 15 and is used to lever up the lid upon rotation of the clip.

In both embodiments of FIGS. 10-12 and FIGS. 13-16, as the lid 20 is forced off its seat on the base's top edge 13, seal 22 slides up past the inner surface 21 of base side wall 18 and releases its lateral flexibility against the inner surface 21 to allow air to pass between the seal and inner surface and equalise the gas in the container.

Seal 22 as shown is a vertical seal mounted on a rigid post 49 depending down from the underside 23 of lid 20. As a vertical seal, seal 22 has a tight lateral tolerance compared to, for instance, a lip seal which has more lateral give. A vertical seal theoretically provides a greater sealing ability and is therefore more difficult to break in order to remove a lid. Either type of seal can be used in the present storage container, or still other types of seals may be employed, depending on the sealing characteristics sought, which will vary with different seal types.

To further assist in lid removal, a venting means may be provided. The venting means could encompass various forms. In one form, as illustrated in FIGS. 13 to 16, and 17 and 18, the venting means is a vent slot 50 located as an inclined, or chamfered, cut-out or recess on an inner edge of the top edge of the base side wall 18. The vent slot 50 opens the container interior to atmosphere as the cam surface of the C hook and/or the levered edge 31 wedges or levers the lid off the base's top edge 13. Vent slot 50 acts as an air equaliser to equalise the pressure differential across the seal, which will lessen the force required to complete lifting the lid.

Figure 18:
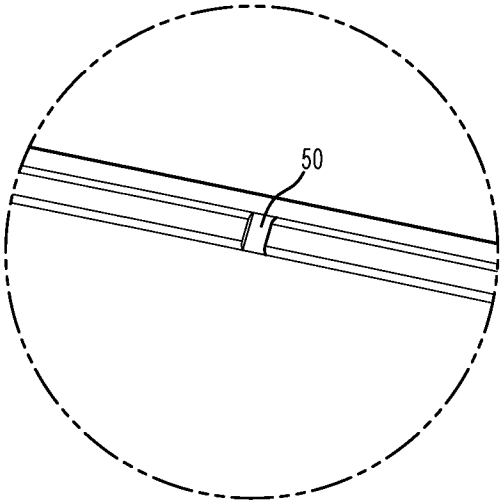
FIG. 18 is an enlarged view of area circled in dashed line shown in FIG. 17.
Figure 17:
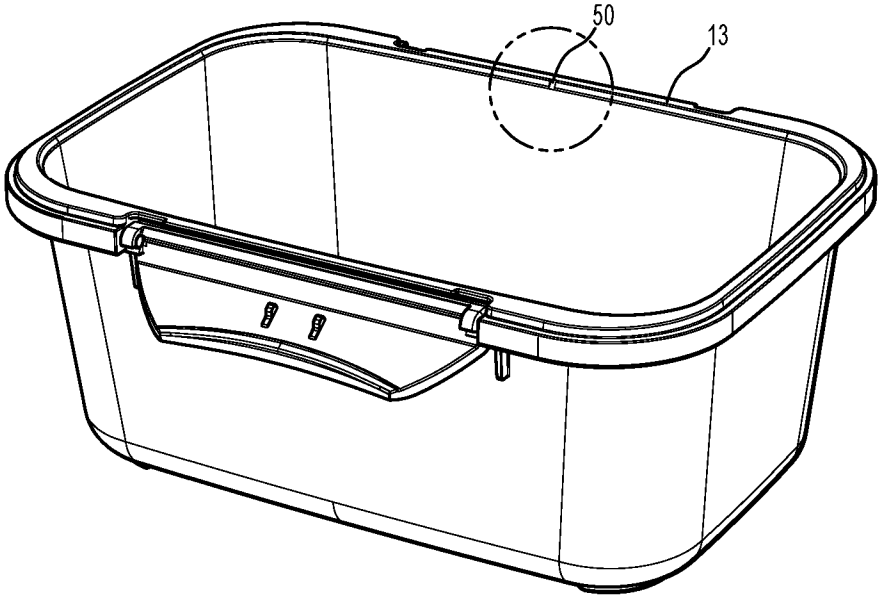
FIG. 17 is an upper isometric view of an alternative embodiment of the storage container.

FIGS. 17 and 18 illustrate vent slot 50 located substantially centrally of the clip cut-out 42 but on the inner top edge of wall 18.

In another version of the venting means, a vent may be formed as an aperture or hole (not shown) in the clip niche 33 of the lid 20. A plug on the underside of the clip 15 that corresponds in shape and size to the vent aperture would plug the vent in lid in the engaged position. During the initial rotation of the clip and before the lid begins to lift off the base, the plug would open the vent aperture equalising the pressure inside the container. Continued rotation of the clips would still cause the cam mechanism to wedge under, and lift, the lid thereby presenting the lid for easy removal, as discussed above.

In still another version, the venting means could be provided as a venting button on the upper surface 24 of the lid 20, whereby the venting button pivots on a fulcrum between an open and closed position to allow or deny air transfer through the button.

The base, clip and lid are in the preferred embodiment are made of a plastics material that is durable for repeated re-use, microwaveable and dishwashable. All components are preferably made of the same material. Examples of such materials include homopolymer or copolymer polypropylenes, The circumferential seal could be overmoulded on the lid, or may be separately moulded and then assembled with the lid. The seal could be made of a suitable seal material that provides some flexibility or resilience, the degree to which the seal is flexible being selected according to seal design the desired strength of sealing sought. An example of such a material is thermoplastic rubber (TPR).

The present storage container provides users with a container that can exhibit an enhanced sealing ability yet still allow for effortless removal of the lid against the strength of the seal. This is achieved by providing a lever in the form of a clip that upon rotation levers (by wedging or pushing) the lid off the base so that the lid sits freely and unhindered from easy removal by simply lifting the lid off the base.

Furthermore, lifting the lid off the base by way of the side clips means the lid can still rest on the base in an unsealed manner. This is useful, for example, when using the container in a microwave. There is a sufficient gap in gap 44 to allow steam generated inside the container to escape without having to remove the lid, which will block splatter in the microwave oven, or necessarily provide steam vents in the lid or base.

It will be understood to persons skilled in the art of the invention that many modifications may be made without departing from the spirit and scope of the invention.

The invention claimed is:

1. A storage container comprising:

a container base having an upper opening defined by a peripheral top edge of the base;

a removable lid with a circumferential seal, wherein the lid sealingly sits across the upper opening of the base; and a clip mounted to the base to rotate on a rotational axis between an engaged position whereby the clip engages the lid against removal and a disengaged position, the rotational axis being substantially parallel and offset to the peripheral top edge of the base;

wherein the clip is pivotally mounted to the base at two ends with a gripping portion extending in-between and one or more clipping lugs provided on an underside of the clip in-between the two ends resiliently engage a clipping recess on the lid to secure the clip with the lid, and wherein as the clip rotates to the disengaged position, a contact surface on the clip applies a lifting force on the underside of the lid to assist in lifting the lid off the peripheral top edge.

2. The storage container as claimed in claim 1, wherein the contact surface is a pivoting component on the clip that is profiled to progressively increase a lifting force on the underside of the lid.

3. The storage container as claimed in claim 1, wherein as the clip is rotated the contact surface progressively pushes against the underside of the lid.

4. The storage container as claimed in claim 1, wherein the contact surface is provided on a levered edge of the clip located between the two ends and is levered by the gripping portion.

5. The storage container as claimed in claim 1, wherein the contact surface is a cam member that creates a wedging force against the underside of the lid as the clip is rotated.

6. The storage container as claimed in claim 5, wherein the cam member, in cross section, has a narrow section leading into a larger section.

7. The storage container as claimed in claim 5, wherein end catches of the ends of the clip are mounted on corresponding pins on the base, and the contact surface is provided on the end catches.

8. The storage container as claimed in claim 1, comprising one or more struts depending downwardly from the underside of the lid against which the contact surface lifts the lid.

9. The storage container as claimed in claim 1, wherein the clip is configured to interact with the lid so that as the clip engages the lid an audible click is made.

10. The storage container as claimed in claim 1, comprising a vent in the lid or base that opens as the clip rotates from the engaged position.

11. The storage container as claimed in claim 10, wherein the vent is a cut-out in an inner edge of a top edge of the base.

12. A storage container comprising:

a container base having an upper opening defined by a peripheral top edge of the base;

a removable lid with a circumferential seal, wherein the lid sealingly locates across the upper opening of the base; and a clip pivotally mounted to the base at two end hinges has a gripping portion extending in-between, where one or more clipping lugs provided on an underside of the clip in-between the two end hinges resiliently engage a clipping recess on the lid to secure the clip with the lid, wherein the clip is configured to rotate on a rotational axis between an engaged position whereby the clip engages the lid against removal, and a disengaged position whereby the clip does not engage the lid, the rotational axis being substantially parallel and offset to the peripheral top edge of the base;

wherein the clip includes a cam surface at or adjacent to at least one end hinge, so that as the clip rotates from the engaged position to the disengaged position, the cam surface is moved to apply a lifting force on the underside of the lid to lift the lid against the sealing force of the seal.

13. The storage container as claimed in claim 12, wherein the cam surface is provided on a "C" hook that mounts on a pivoting pin on the base.

* * * * *